US007299594B2

(12) United States Patent
Chornenky et al.

(10) Patent No.: US 7,299,594 B2
(45) Date of Patent: Nov. 27, 2007

(54) BRICK PATTERNED SHELVING

(76) Inventors: Todd E. Chornenky, 125 Cambridge Rd., Bethel Park, PA (US) 15102; Daniel Chornenky, 17 Kadar La., Elizabeth, PA (US) 15037

( * ) Notice: Subject to any disclaimer, the term of this patent is extended or adjusted under 35 U.S.C. 154(b) by 125 days.

(21) Appl. No.: 10/635,623

(22) Filed: Aug. 6, 2003

(65) Prior Publication Data

US 2004/0103591 A1 Jun. 3, 2004

Related U.S. Application Data

(60) Provisional application No. 60/401,658, filed on Aug. 6, 2002.

(51) Int. Cl.
*B44F 7/00* (2006.01)
*B44F 9/00* (2006.01)

(52) U.S. Cl. ..... 52/314; 52/357; 52/386; 52/612; 52/36.5

(58) Field of Classification Search ..... 52/387, 52/389, 386, 506.05, 309.1, 598, 604, 612, 52/36.5, 314, 316, 36.3; 248/235, 237, 248, 248/250

See application file for complete search history.

(56) References Cited

U.S. PATENT DOCUMENTS 1,478,425 A * 12/1923 Dickinson ..... 434/74
2,419,047 A * 4/1947 Young ..... 52/314
2,847,721 A * 8/1958 Diamond ..... 52/314
2,908,471 A * 10/1959 Hollansworth ..... 248/247
3,641,731 A * 2/1972 Winfree ..... 52/747.12
3,718,101 A * 2/1973 Sacks ..... 108/152
4,106,247 A * 8/1978 Svensson ..... 52/204.2
4,238,915 A * 12/1980 Yoshida et al. ..... 52/510
4,245,776 A * 1/1981 Miner ..... 232/43.3
4,727,698 A * 3/1988 Altman ..... 52/314
5,373,676 A * 12/1994 Francis et al. ..... 52/387
5,671,725 A * 9/1997 Dishaw ..... 125/21
5,711,115 A * 1/1998 Wirt ..... 52/36.3
5,930,964 A * 8/1999 Boehning ..... 52/309.1
6,053,465 A * 4/2000 Kluge ..... 248/235
6,054,080 A * 4/2000 Sheahan et al. ..... 264/71
6,273,380 B1 * 8/2001 Fillipp et al. ..... 248/231.91
6,375,137 B1 * 4/2002 McQuade et al. ..... 248/205.1
6,386,194 B1 * 5/2002 Christman ..... 126/500
6,415,578 B1 * 7/2002 DiCamillo ..... 52/747.12
6,658,793 B2 * 12/2003 Perron ..... 49/123
6,746,297 B2 * 6/2004 Robjent et al. ..... 446/108
2003/0183220 A1 * 10/2003 Herres et al. ..... 126/521

* cited by examiner

*Primary Examiner*—Richard E. Chilcot, Jr.
*Assistant Examiner*—Chi Q. Nguyen
(74) *Attorney, Agent, or Firm*—James Ray & Assoc.

(57) ABSTRACT

An apparatus for at least one of providing a decorative shelf, decorative framing, decorative shelving, decorative paneling and a decorative member for supporting and hanging preselected articles. The apparatus comprises a panel member formed with a brick like design adjacent an outer surface thereof and having each of a first predetermined shape and a predetermined thickness and at least one of an opening, having a second predetermined shape, formed in the panel member to provide a frame like member for at least one of a mirror and a picture and a means formed in the brick like design for supporting at least one of a shelf and a bracket for supporting and hanging such preselected articles.

12 Claims, 7 Drawing Sheets

BRICK PATTERNED SHELVING

CROSS-REFERENCE TO RELATED APPLICATIONS

This application is closely related to and claims benefits from U.S. Provisional Application Ser. No. 60/401,658 filed Aug. 6, 2002.

FIELD OF THE INVENTION

The present invention relates, in general, to a decorative and useful wall paneling and, more particularly, the present invention relates to brick patterned wall paneling and shelving that is supported by such panels.

BACKGROUND OF THE INVENTION

Paneling has been used for countless number of years for many reasons. It may be to improve the appearance of a room, to eliminate the need for painting or for other decorative ideas.

However, one problem that is frequently encountered with paneled areas is that generally there is a problem if a person wants to put up shelving on a paneled wall. Unfortunately too often it becomes very difficult to find shelving that matches the wall decor. Another problem is that the studs that must be found in order to mount the shelves are often not located where it is desirable to mount the shelves.

Also, decorative wall mounts which can easily be installed and in which attachments can be secured to the wall mount without tools are virtually impossible to find and thus would be a welcome addition for decorating a room.

SUMMARY OF THE INVENTION

Therefore, the present invention provides in a first embodiment an apparatus for at least one of providing a decorative shelf, decorative framing, decorative shelving, decorative paneling and a decorative member for supporting and hanging preselected articles. The apparatus comprises a panel member formed with a brick like design adjacent an outer surface thereof and having each of a first predetermined shape and a predetermined thickness and at least one of an opening, having a second predetermined shape, formed in the panel member to provide a frame like member for at least one of a mirror and a picture and a means formed in the brick like design for supporting at least one of a shelf and a bracket for supporting and hanging such preselected articles.

An alternate embodiment of the invention provides a panel and shelf combination for use in at least one of decoration, shelving and hanging brackets. The panel and shelf combination comprises a panel having a bricklike design and having at least one of an upper surface and a lower surface of bricks forming the bricklike design having a beveled edge. At least two brackets are engageable with the beveled edge of the bricks forming the bricklike pattern and at least one shelf is supported by the at least two brackets.

OBJECTS OF THE INVENTION

It is the primary object of the present invention to provide an apparatus for providing decorative shelving, decorative paneling and decorative framing for supporting and hanging preselected articles.

Another object of the invention is to provide an apparatus which has an opening formed in the apparatus for framing a mirror or a picture.

Yet another object of the invention is to provide an apparatus with a bricklike panel in which the bricks in the bricklike design have a beveled surface.

Still another object of the invention is to provide an apparatus with a panel that has a bricklike design and which panels are easily connected to each other.

It is yet another object of the invention to provide a shelf and bracket arrangement which engages to the beveled edge of the bricks.

Still another object of the invention is to provide a panel and shelf arrangement in which the shelves can be moved easily to different locations on the panel.

Yet another object of the invention is to provide a panel of various widths and lengths as decorative wall mounts.

Still another object of the invention is to provide a panel in which various items can be mounted on the panel such as brackets, shelves, mirrors, photographs and such.

In addition to the numerous objects and advantages of the present invention which have been described with some degree of particularity above, it should be both noted and understood that a number of other important objects and advantages of the tool will become more readily apparent to those persons who are skilled in the relevant art from the following more detailed description of the invention, particularly, when such detailed description is taken in conjunction with the appended claims.

Figure 1:
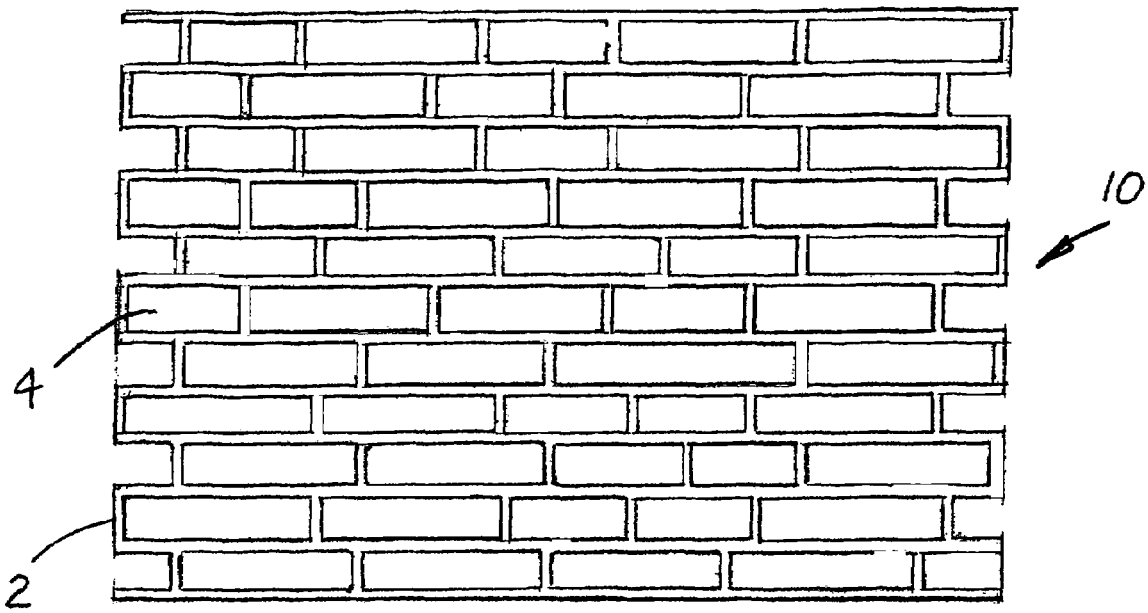
FIG. 1 is a frontal view of a panel having a bricklike appearance in a first embodiment of the invention.

BRIEF DESCRIPTION OF THE PRESENTLY PREFERRED AND VARIOUS ALTERNATE EMBODIMENTS OF THE PRESENT INVENTION

Prior to proceeding with the more detailed description of the present invention it should be noted that, for the sake of clarity identical components which have identical functions have been designated by identical reference numerals throughout the several views illustrated in the drawings.

Figure 2:
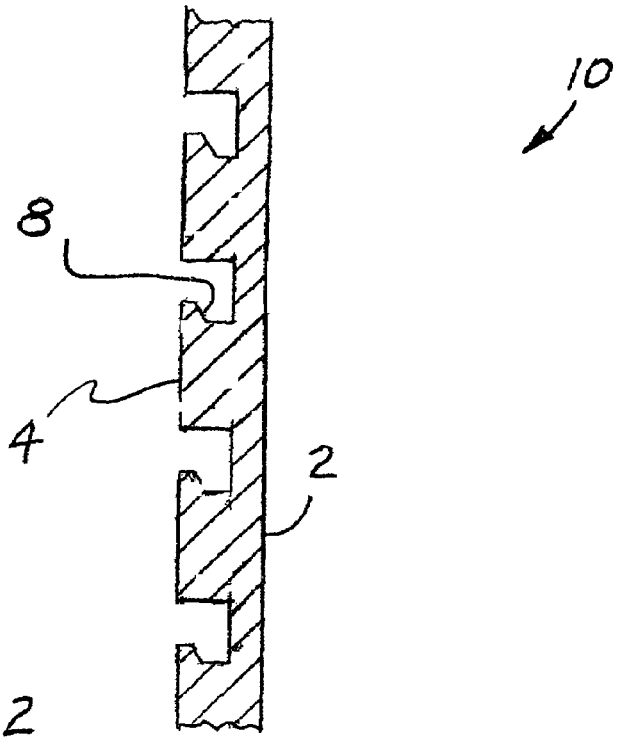
FIG. 2 is a side view of the panel in FIG. 1.
Figure 3:
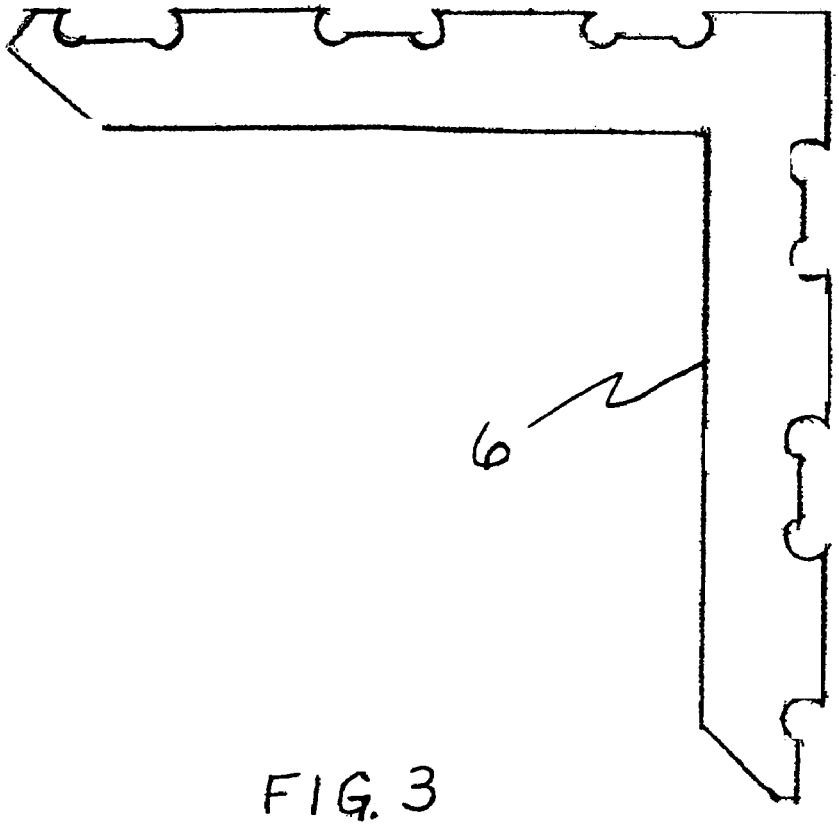
FIG. 3 is a side view of a bracket for attaching to the panel of FIG. 1.

Illustrated in FIGS. 1 and 2 is an apparatus, generally designated 10, which includes a panel member 2 having a bricks 4 formed in the panel member 2 to provide a bricklike appearance and to which a bracket and shelf can be attached. Such bracket 6, shown in FIG. 3, interlocks with the groove 8 formed on an upper side of the bricks 4 in the bricklike panel 2 and is held in place by the groves 8. Such groove 8 which is formed on the upper side of the bricks may be beveled having a generally triangular shape or it may be rectangular. A similar groove may also be formed on the underside of each brick 4. The brackets 6 can be moved to any location on the panel. Such brackets 6 can also be mounted upside down with the bracket 6 acting as a bookend.

Figure 4:
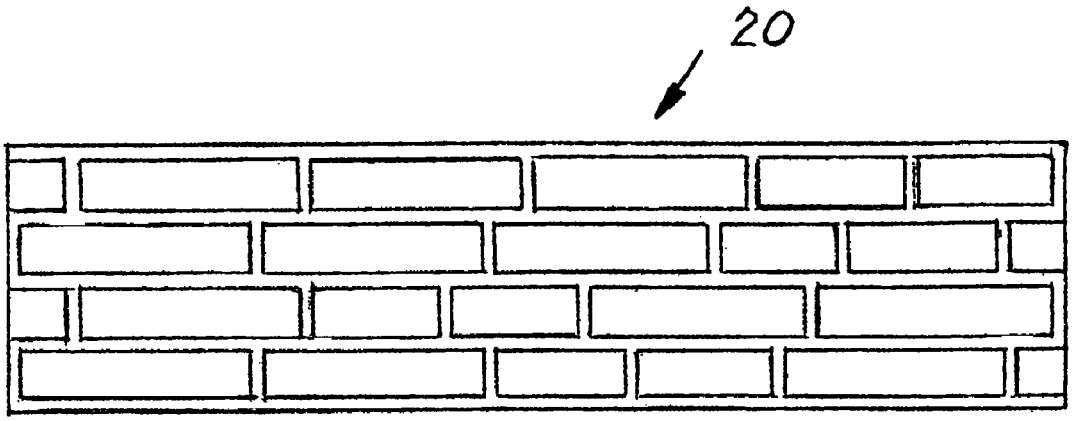
FIG. 4 is a view of the underside of a shelf for mounting on the bracket shown in FIG. 3.

In one embodiment of the invention such shelf, generally designated 20, shown in FIG. 4 has a bricklike appearance on the underside of the shelf. This appearance is similar to the bricklike appearance of the panel member 2. The shelf 20 snaps in place on the bracket 6 similar to the manner in which the bracket 6 engages the grooved portion 6 of the bricks 4. The upper surface of the shelf is smooth and does not have a bricklike appearance. In another embodiment of the invention the bottom surface of the shelf 20 is also smooth and does not have the bricklike appearance.

Figure 8:
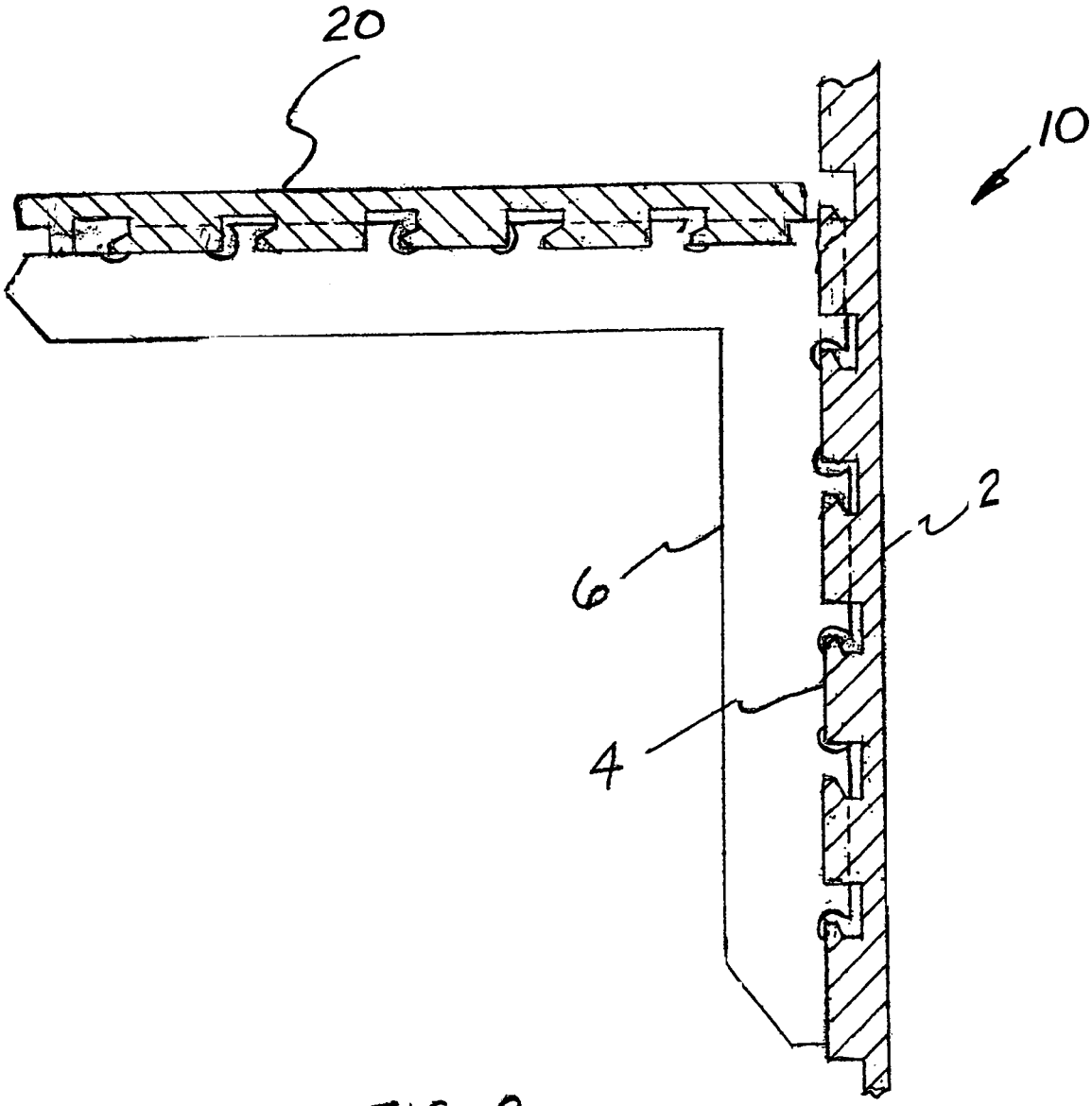
FIG. 8 is a side view of a portion of the panel with a bracket and shelf attached.
Figure 9:
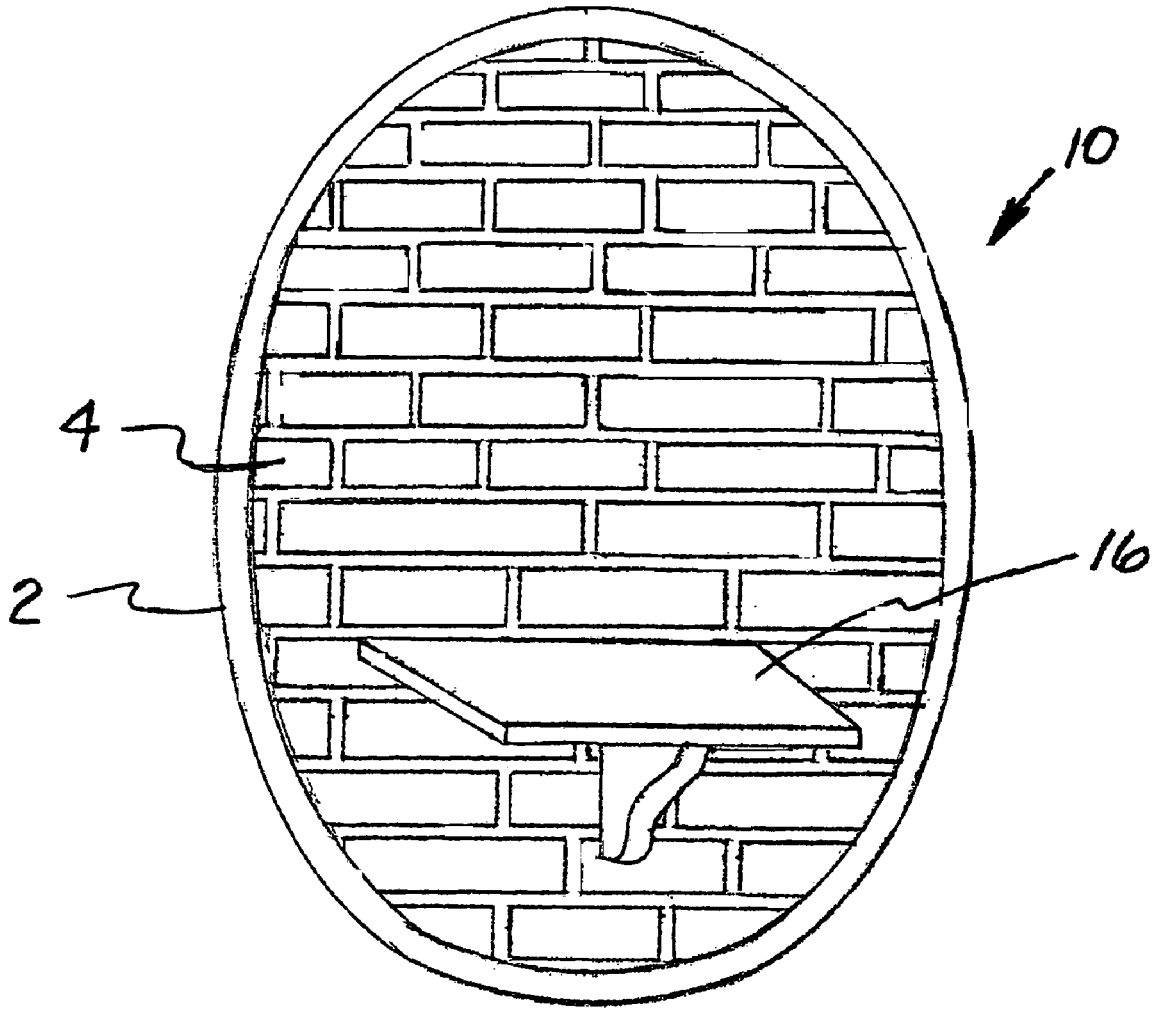
FIG. 9 is frontal view of a panel having a brick like appearance in which the panel has an oval shape according to an embodiment of the invention.

FIG. 8 shows a cross section of such panel member 2 having a bracket 6 attached to the panel member 2. There is also a shelf 20 that is attached to such bracket 6.

In other embodiments of the invention such shelf 20, or other member mounted to the panel member 2, is attached to the bricklike panel by means of a cam, by means of an expanding back edge, by means of an insert in the top of the edge and by a protruding latch. Horizontal movement can be prevented by a protrusion into vertical mortar slots.

Figure 5:
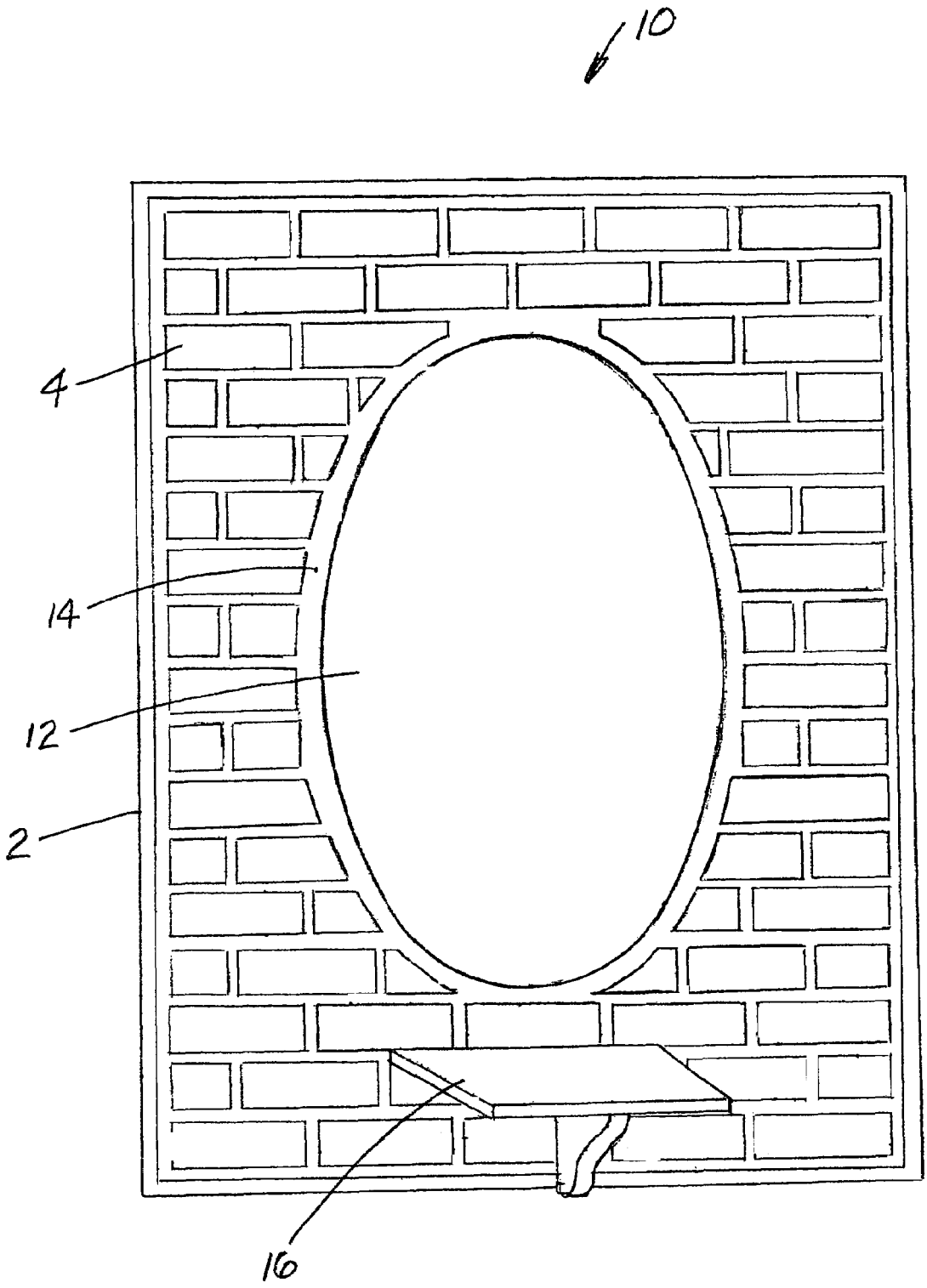
FIG. 5 is frontal view of a panel having a brick like appearance in which the panel has an oval shape according to an embodiment of the invention.
Figure 6:
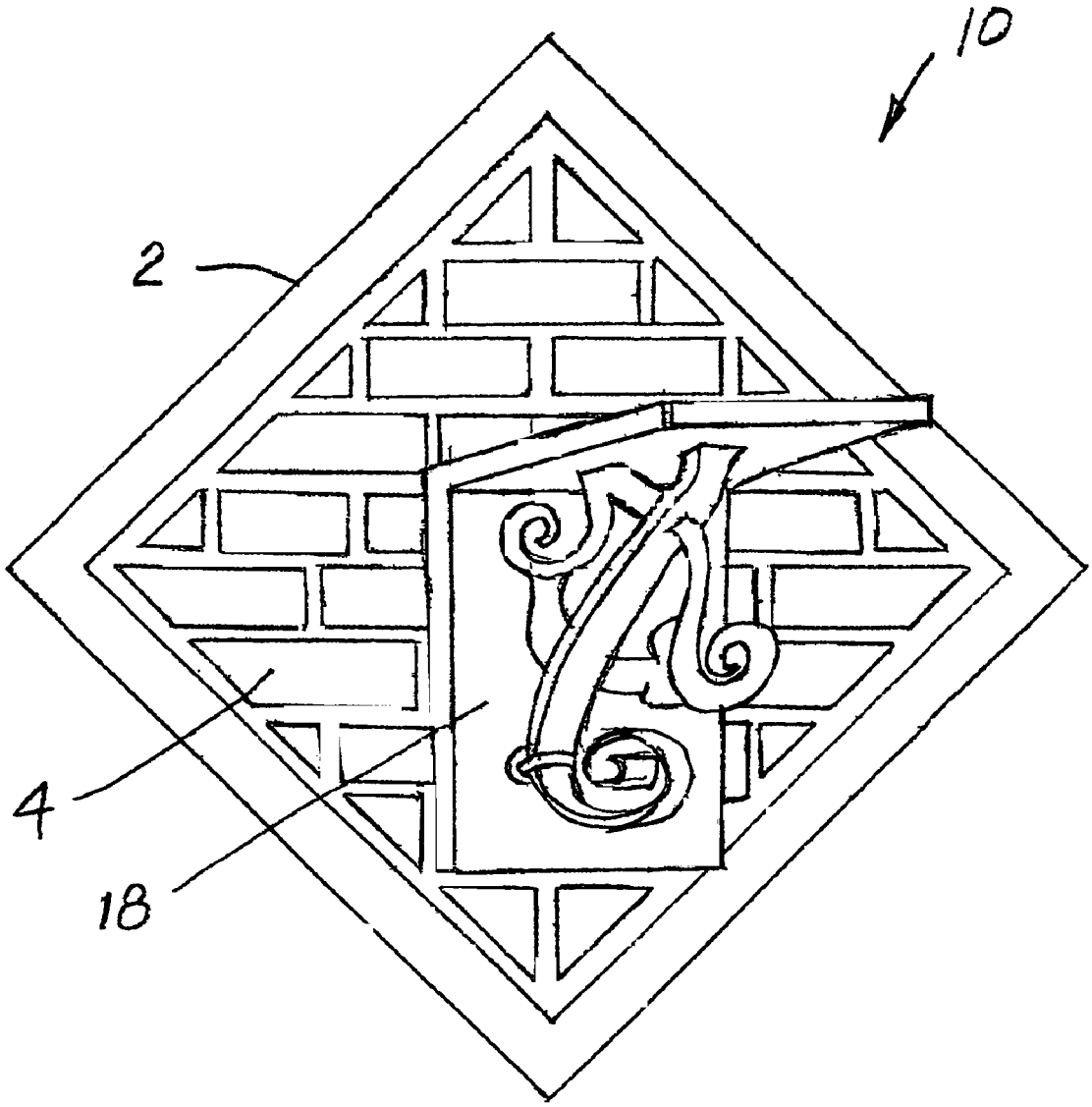
FIG. 6 is frontal view of a panel having a brick like appearance in which the panel has a rhomboid shape according to an embodiment of the invention.
Figure 7:
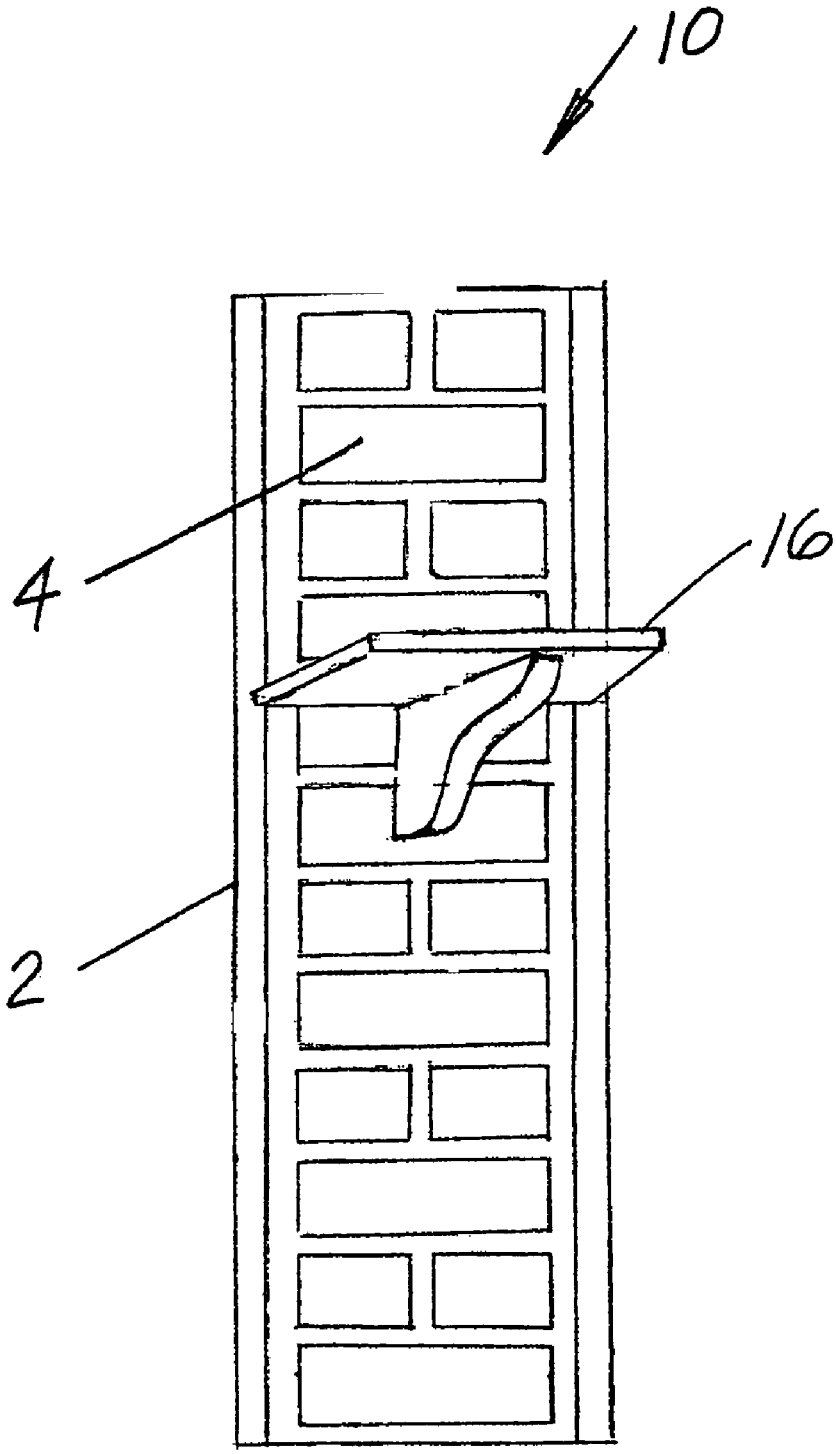
FIG. 7 is frontal view of a panel having a brick like appearance in which the panel has a rectangular shape according to an embodiment of the invention.

In another embodiment of the invention as is evident in FIGS. 5, 6 and 7, such apparatus 10 includes a panel member 2 which has a variety of shapes. Such apparatus 10 provides a panel member 2 which is formed with a brick 4 like design adjacent an outer surface of such panel member 2. Such panel member 2 has a first predetermined shape and a predetermined thickness. The panel member 2 has at least one of an opening 12 which has a second predetermined shape formed into such panel member 2 for providing a frame like member 14 for at least one of a mirror and a picture. There is further a means formed in the brick 4 like design for supporting at least one of a shelf 16 and a bracket 18 for supporting and hanging selected articles.

The panel member 2 may be made in a variety of widths and a variety of heights. The panel member 2 can be stained or painted to whatever color or design desired by the user. The predetermined shape of such panel member 2 can be oval, rectangular, square, round, hexagonal, octagonal, rhomboid and triangular or any shape desired for proper decoration.

In this decorative embodiment the warmth of wood combines with the beauty of a brick appearance to form a functional wall decoration. There are a variety of attachments that can be mounted on the apparatus 10. The bracket 18 or the shelf 16 may be used for trophy displays, floral arrangements, terraria, mounted photographs, lamps, candlestick holders, clocks etc. While items such as diplomas, artwork, certificates can be mounted directly on the panel member 2. Also the panel member can be used to mount cabinetry directly on the panel member 2 without the need of a hammer nails or screws.

There is an unlimited variety of sizes and shapes of the brick like panels 2 that can be combined to form any design imaginable since as mentioned previously the panel member 2 can be oval, rectangular, square, round, hexagonal, octagonal, rhomboid and triangular or any other shape desired. Further the panel members 2 can contain "invisible" wire ways to accommodate and hide electrical cables inside the panels since the wires can simply slide down holes in the grooves 8 behind the brick 4 in the hidden mortar-brick groove 8 cutout.

In yet another embodiment of the invention there is a panel member 2 and shelf 20 combination for use in at least one of decoration, shelving and hanging brackets. The panel 2 and shelf 20 combination comprise a panel 2 having a bricklike design and having at least one of an upper surface and a lower surface of bricks 4 forming the bricklike design having one of a beveled edge (groove) 8. There is at least one bracket 6 engageable with the beveled edge 8 of the bricks 4 forming the bricklike pattern and at least one shelf 20 supported by the at least one bracket 6.

The brackets 6 of the combination of such panel 2 and such shelf 20 are directly mountable to the panel 2 without the use of any external materials. Also the brackets 6 and shelves 20 can be mounted in various locations on the panel 2 very easily. The grooves 8 on the brick pattern is used for interlocking the bracket 6 and the shelves 20 to the panel member 2. In this embodiment one panel member 2 can interlock with another panel member 2 to form an extended wall surface. Many panel members 2 can be interlocked to form at least one of a continuous wall surface and a continuous ceiling surface.

While a presently preferred and an alternative embodiment of the present invention have been described in detail above, it should be understood that various other adaptations and/or modifications of the present invention can be made by those persons who are particularly skilled in the related art without departing from either the spirit of the invention or the scope of the appended claims.

We claim:

1. An apparatus for at least one of providing a decorative shelf, decorative framing, decorative shelving, decorative paneling and a decorative member for supporting and hanging preselected articles, said apparatus comprising:

(a) a panel member formed with a brick wall adjacent an outer surface thereof and having each of a first predetermined shape and a predetermined thickness, said brick wall is used for interlocking shelves to said panel member; and (b) at least one of an opening, having a second predetermined shape, formed in said panel member to provide a frame like member for at least one of a mirror and a picture and a means formed in said brick wall for supporting at least one of a shelf and a bracket for said supporting and hanging such preselected articles and wherein said panel member further includes a formed border adjacent outer edges of said panel member.

2. The apparatus, according to claim 1, wherein said at least one of shelf and a bracket are directly mountable to said panel member without the use of any external materials.

3. The apparatus, according to claim 1, wherein said at least one of shelf and a bracket can be mounted in various locations on said panel member.

4. The apparatus, according to claim 1, wherein said predetermined shape of said panel member is one of an oval, rectangular, square, round, hexagonal, rhomboid and triangular shape.

5. The apparatus, according to claim 1, wherein said predetermined shape of said opening formed in said panel member is oval.

6. The apparatus, according to claim 1, wherein said means formed in said brick wall for supporting at least one of a shelf and a bracket for said supporting and hanging such preselected articles include a beveled edge on bricks in said brick like design.

7. A panel and shelf combination for use in at least one of decoration, shelving and hanging brackets, said panel and shelf combination comprising:

(a) a panel having a brick wall and having at least one of an upper surface and a lower surface of bricks having a beveled edge;

(b) at least one bracket engageable with said beveled edge of said bricks forming said bricklike pattern; and (c) at least one shelf supported by said at least one bracket, said wall is used for interlocking said at least bracket and said at least one shelf to said panel member and wherein said panel member further includes a formed border adjacent outer edges of said panel member.

8. The combination, according to claim 7, wherein said brackets of said shelf and panel combination are directly mountable to said panel without the use of any external materials.

9. The combination, according to claim 7, wherein said shelf can be mounted in various locations on said panel.

10. The combination, according to claim 7, wherein said panel can interlock with another said panel to form an extended surface.

11. The combination, according to claim 10, wherein said panel can interlock with a plurality of said panel to form at least one a continuous wall surface and a continuous ceiling surface.

12. The combination, according to claim 7, wherein said at least one shelf has a brick design on a bottom surface of said shelf similar to said brick wall of said panel.

* * * * *